United States Patent [19]

Mehl

[11] 4,360,357

[45] Nov. 23, 1982

[54] TRANSFER-PRINTING CARRIERS: RED COMPONENT DYE MIXTURE FOR POLYACRYLONITRILE

[75] Inventor: Wolfgang Mehl, Geneva, Switzerland

[73] Assignee: Ciba-Geigy AG, Basel, Switzerland

[21] Appl. No.: 275,028

[22] Filed: Jun. 18, 1981

[30] Foreign Application Priority Data

Jun. 20, 1980 [CH] Switzerland ..... 4753/80

[51] Int. Cl.[3] ..... D06P 1/645

[52] U.S. Cl. ..... 8/471; 8/638; 8/643; 8/927

[58] Field of Search ..... 8/471, 643, 638, 927

[56] References Cited

U.S. PATENT DOCUMENTS 3,888,623 6/1975 Clarke et al. ..... 8/643
4,159,192 6/1979 Mockli ..... 8/471

OTHER PUBLICATIONS

Venkataraman's "The Chemistry Of Synthetic Dyes," vol. VIII, (Academic Press), 1978, pp. 203–205.
Transfer Printing Manual, (National Knitted Outerwear Association, New York), 1976, p. 57.

*Primary Examiner*—A. Lionel Clingman
*Attorney, Agent, or Firm*—Wenderoth, Lind & Ponack

[57] ABSTRACT

The invention relates to transfer-printing carriers for printing sheet-like articles made from polyacrylonitrile, which carriers carry, as the red component, a mixture of dyes of the two types

I:

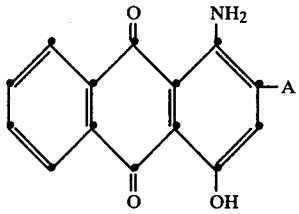

and

II.

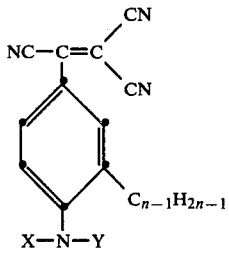

wherein A is an ether group, n is an integer having a value of at most 4, X is a hydrogen atom or a low-molecular alkyl group optionally containing substituents, and Y is a low-molecular alkyl group optionally containing one substituent. The ratio of the dyes of the types I and II present in the mixture has to be 1:3 to 3:1.

7 Claims, No Drawings

TRANSFER-PRINTING CARRIERS: RED COMPONENT DYE MIXTURE FOR POLYACRYLONITRILE

The present invention relates to novel transfer-printing carriers, particularly to those made from paper, for the dry transfer printing of polyacrylonitrile fibres.

The transfer-printing technique which is widely used for polyester fibres, whereby polyester fibre materials are printed by being brought dry at 200° to 210° C. into contact with a carrier carrying the design to be transferred, for example by the process described in the French Patent Specification No. 1,585,119, has not become properly established in the case of textile materials made from polyacrylonitrile. Neither the transfer-printing carriers of the French Pat. No. 2,262,612, with which the process can be carried out at lower temperatures, nor those of the French Pat. Nos. 2,243,831 and 2,310,225, which use cationic dyes, have been fully accepted by the customers. This is mainly on account of the lacking fastness to light of the red component of the transferable cationic dyes, and also because it has not been possible to produce brilliant red designs with the transfer-printing carriers printed by means of transferable disperse dyes, in themselves sufficiently fast to light on polyacrylonitrile.

These disadvantages of the known technology have been overcome by the novel transfer-printing carriers of the present invention.

The novel transfer-printing carriers are characterised in that they carry, on a flexible, heat-resistant base, for example on a paper web, a design which at 180° to 210° C. is volatile, that is to say, is sublimable or vaporisable, and which contains as the red component a mixture of dyes of the following two types

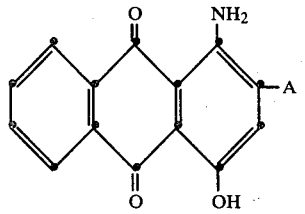

I.

and

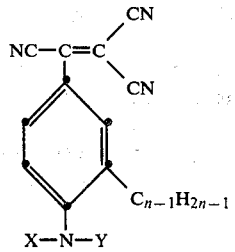

II.

wherein A is an ether group (for example a methoxy, phenoxy or hydroxyethoxy group), n is an integer having a value of at most 4, X is a hydrogen atom or a low-molecular alkyl group optionally containing substituents, and Y is a low-molecular alkyl group optionally containing one substituent, the dyes of the types I and II present in the mixture being in the ratio to one another of 1:3 to 3:1. That means that in the dye mixture according to the invention the content of dye of the one type is at least 25 percent by weight, preferably however at least 35 percent by weight, relative to the content of dye of the other type. There can however be present in the stated ratio also several dyes of the one type with one or more dyes of the other type.

The invention relates also to a process for printing sheetlike objects made from synthetic or partially synthetic polymeric materials using the transfer-printing principle, in which process there is used a transfer-printing carrier which carries a design that is volatile at 180° to 210° C., the red component of this design consisting of a mixture of dyes of the two types I and II in the ratio of at least 1:3 up to at most 3:1 of the one dye type relative to the other.

Further subject matter of the invention are printing inks and printing pastes for transfer printing, and also the substrates, particularly fabrics, knitted goods and velvet made from polyacrylonitrile, as well as more or less high-pole plush and high-shaft carpets made from polyacrylonitrile, and materials similar to polyacrylonitrile, which have been printed with the said type of transfer-printing carriers, that is to say, materials having as the red component a mixture of the stated type.

The transfer-printing process is in general known (cp. for example Colour Index, 3rd Edition, Vol. 2, page 2480), and is for example described in detail in the French Pat. Nos. 1,223,330, 1,334,829 and 1,585,119. In the described process, so-called auxiliary carriers (transfer-printing carriers), which have been printed with suitable printing inks, are brought into close contact with the substrate to be printed, whereupon the dye, by the action of heat and if necessary pressure is transferred from the carrier to the substrate. Transferring under reduced pressure, for example at 80 to 110 mbars, is likewise possible, whereby the transfer temperature can be kept lower and/or the rate of transfer increased.

Suitable auxiliary carriers are sheet-like materials, such as paper, cellophane, cotton fabrics, linen fabrics, metal sheets, and so forth. Paper is the preferred material.

The printing inks can be applied by customary printing methods.

The composition of the printing inks is governed by, inter alia, the type of substrate, of printing process and of carrier material.

Particularly suitable printing processes for producing printed paper auxiliary carriers are photogravure printing and rotary screen printing.

Suitable substrates are preferably sheet-like materials, such as fleeces, felts, pelts, sheeting and, in particular, fabrics and knitted goods made from polyacrylonitrile and materials similar to polyacrylonitrile (Modacryl).

The production of the starting dyes is known per se, and many dyes of the types mentioned are obtainable commercially. Mention may be made just of the Disperse Red dyes 4, 55, 55:1, 60 and 91 listed in the Colour Index of the Society of Dyers and Colourists. The tricyanovinyl dyes of Type II are known from the patent literature (cp. for example the German Offenlegungsschrift No. 2,741,392).

The dye mixtures can be produced by various methods. A suitable method, in addition to that of mechanically mixing together the dry individual components after these dyes have been produced, is the mixing together of at least two liquid printing inks each containing at least one dye of one of the types mentioned. The respective amounts of the two printing inks obviously have to be selected so that, account being taken of the dye concentration, there is obtained, after mixing, a printing ink containing the two dyes of the given types in the specified ratio.

The transfer-printing carriers according to the invention are obtained with these printing inks using customary printing methods. The said carriers produce on polyacrylonitrile materials, with application of the transfer-printing method, brilliant red designs, the fastness to light of which is surprisingly greater than that of the designs obtained with the individual dyes of type II. The brilliancy of the designs is likewise significantly better than that of the designs obtained from dyes of the type I, and, for practical purposes, almost equal to that of the corresponding designs obtained from dyes of the type II. The fastness to rubbing is excellent.

Except where otherwise stated in the Examples which follow, 'parts' are parts by weight, percentages are percent by weight, and temperature values are given in degrees Centigrade.

EXAMPLE 1

35 parts of 1-amino-2-methoxy-4-hydroxy-anthraquinone are mixed with 40 parts of the dye of the formula

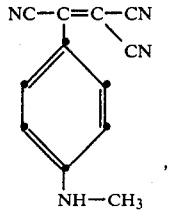

50 parts of a dispersing agent (lignosulfonate or a condensation product of naphthalenesulfonic acid and formaldehyde) and 100 parts by volume of water, and the mixture is converted in a ball mill, by being ground for 10 hours, into a finely divided form. The resulting dispersion containimg about 30% of crude dye is stirred to a paste with 400 parts of a 10% locust bean flour ether thickening and 500 parts by volume of water. A paper is printed with this printing paste either in the rotary screen printing process of photogravure printing process. When this paper is pressed for 15 to 60 seconds at 200° against a textile made from polyacrylonitrile fibres, a full brilliant red printing having excellent fastness to light is obtained.

EXAMPLE 2

20 parts of 1-amino-2$\beta$-hydroxyethyloxy-4-hydroxyanthraquinone are stirred to a paste with 30 parts of the dye of the formula

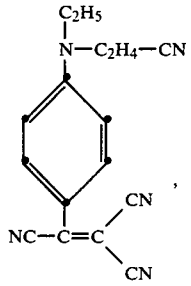

5 to 10 parts of an emulsifier mixture of ethoxylated nonylphenol (4 to 12 mols of ethylene oxide) in water. 50 parts of ethyl cellulose $N_4$ (Hercules Powder) are added; the mixture is subsequently kneaded for two hours and is then ground in a customary mill. The dye powder thus obtained is added, with stirring, to a mixture of 730 g of ethanol,
50 g of ethylene glycol and
20 g of ethyl cellulose N 22 (Hercules Powder).

The printing ink obtained can be used to print papers in the photogravure printing process. From these printed papers it is possible to print, in the transfer-printing process, polyacrylonitrile textiles, for example knitted fabrics or velvet, at 190° under 100 mbars, with a contact pressure of the back cloth against the transfer-printing paper of about 1 g/cm$^2$, and to thus obtain brilliant red printings having excellent fastness properties.

I claim:

1. In a transfer-printing carrier which carries a design which is volatile at 180° to 210° C., the improvement wherein the design is one which contains as the red component a mixture of dyes of the two types

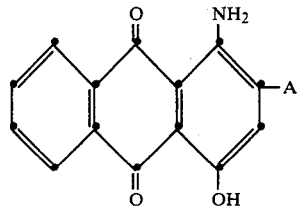

I.

and

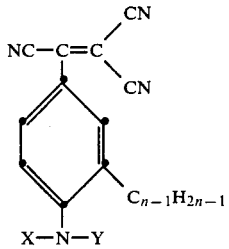

II.

wherein A is methoxy, phenoxy or hydroxyethoxy, n is an integer having a value of at most 4, X is a hydrogen atom or lower alkyl, and Y is lower alkyl, the dyes of the types I and II present in the mixture being in the ratio to one another of 1:3 to 3:1.

2. A transfer-printing carrier according to claim 1, which carries, as a dye of the type II, the dye of the formula

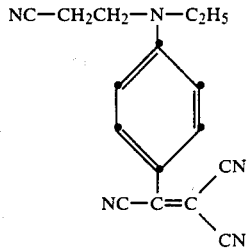

3. A transfer-printing carrier according to claim 1, wherein the weight ratio of type I to type II is 1:2 to 1:1.

4. In a process for printing sheet-like articles made from polyacrylonitrile by the transfer-printing process, the improvement wherein the transfer-printing carrier used is as defined in claim 1.

5. A process according to claim 4, wherein transfer printing is performed under reduced pressure.

6. A process according to claim 4, wherein transfer printing is performed under atmospheric pressure with a transfer-printing carrier which carries a dye of type I wherein A is methoxy.

7. A polyacrylonitrile sheet-like article printed according to the process of claim 4.

* * * * *